US009084457B2

(12) United States Patent
Rizzo

(10) Patent No.: US 9,084,457 B2
(45) Date of Patent: Jul. 21, 2015

(54) MULTIPLE PIECE JEWELRY PIECE AND METHOD OF MANUFACTURE

(75) Inventor: Ron Rizzo, Sea Cliff, NY (US)

(73) Assignee: KRUSH TO PLEVE LLC, NY, NY (US)

( * ) Notice: Subject to any disclaimer, the term of this patent is extended or adjusted under 35 U.S.C. 154(b) by 406 days.

(21) Appl. No.: 13/134,273

(22) Filed: Jun. 3, 2011

(65) Prior Publication Data

US 2012/0304693 A1 Dec. 6, 2012

(51) Int. Cl.
*A44C 27/00* (2006.01)
*A44C 17/02* (2006.01)

(52) U.S. Cl.
CPC ..... *A44C 17/02* (2013.01); *A44C 27/00* (2013.01); *Y10T 29/49588* (2015.01); *Y10T 156/108* (2015.01)

(58) Field of Classification Search
CPC ..... Y10T 29/49588–29/49597; A44C 27/00; A44C 27/001; A44C 27/005; A44C 27/007
USPC ..... 29/896.4–896.43, 428, 458, 460, 10; 63/26–31
See application file for complete search history.

(56) References Cited

U.S. PATENT DOCUMENTS

| | | | | |
|---|---|---|---|---|
| 3,931,719 | A * | 1/1976 | Schwab | 63/28 |
| 4,139,667 | A * | 2/1979 | Blue | 428/38 |
| 4,809,417 | A * | 3/1989 | Normann, Jr. | 29/896.41 |
| 5,155,990 | A * | 10/1992 | Poll | 59/80 |
| 5,748,392 | A * | 5/1998 | Hamada | 359/819 |
| 6,258,418 | B1 | 7/2001 | Rudder et al. | |
| 6,514,605 | B2 | 2/2003 | Rudder et al. | |
| 7,022,403 | B1 | 4/2006 | Lakhotkin et al. | |
| 7,257,319 | B1 * | 8/2007 | Clarke | 392/405 |
| 7,461,452 | B1 * | 12/2008 | Kothari | 29/896.412 |
| 7,596,967 | B2 * | 10/2009 | Ostfeld | 63/32 |
| 2002/0168168 | A1 * | 11/2002 | Iravani | 385/136 |
| 2004/0231158 | A1 * | 11/2004 | Altenberger et al. | 29/896.41 |
| 2005/0196430 | A1 * | 9/2005 | Olsson et al. | 424/443 |
| 2008/0176290 | A1 * | 7/2008 | Joseph et al. | 435/91.2 |
| 2009/0293543 | A1 * | 12/2009 | Sobchenko | 63/28 |
| 2010/0270241 | A1 * | 10/2010 | Annis et al. | 210/691 |
| 2010/0319399 | A1 | 12/2010 | Mandell | |

* cited by examiner

*Primary Examiner* — Christopher Besler
(74) *Attorney, Agent, or Firm* — Philip M. Weiss; Weiss & Weiss

(57) ABSTRACT

A piece of jewelry comprising a base having within it a number of diamonds, other precious stones, or costume jewelry within it, and the method of manufacturing the same.

14 Claims, 4 Drawing Sheets

Fig. 1
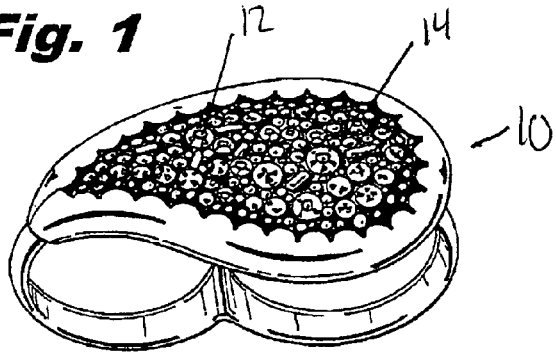
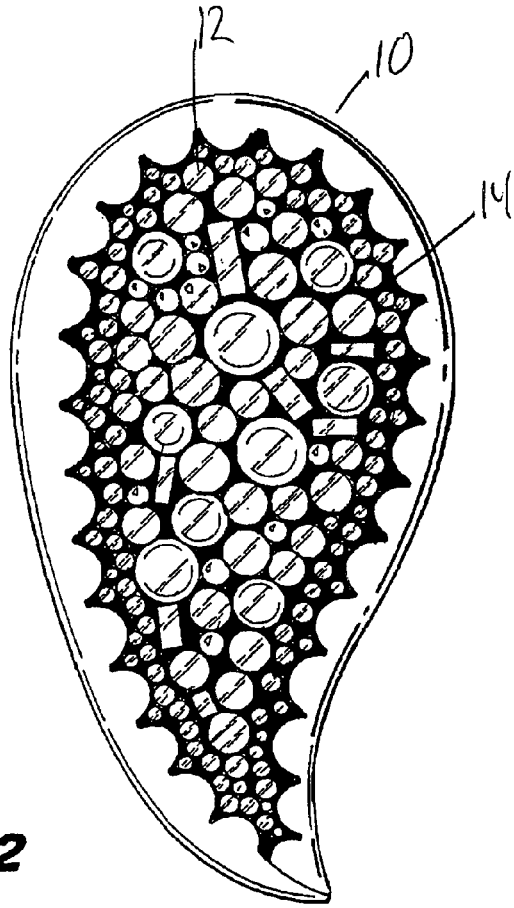
Fig. 2

MULTIPLE PIECE JEWELRY PIECE AND METHOD OF MANUFACTURE

FIELD OF THE INVENTION

The present invention relates to a piece of jewelry which comprises a base having within it a number of diamonds, other precious stones, or costume jewelry within it, and the method of manufacturing the same.

BACKGROUND OF THE INVENTION

U.S. Patent Publn. 2009/0293543 relates to an article of jewelry comprising: a first base having an outer surface and at least two wells; a layer of adhesive material in communication with at least one well; a layer of glitter in communication with at least a portion of the adhesive material in at least one well to provide a glitter adhesive filled well; and at least one gem stone in communication with the layer of adhesive material and at least partially contained in at least one well. The jewelry further contains at least one circular surrounding piece having an outer circumference and a center opening, the center opening corresponding to and surrounding the gem stone and in communication with the layer of adhesive material.

U.S. Patent Publ. 2010/0319399 relates to a virtual whole diamond created from a plurality of stones and having a homogenous table. The invention relates to the duplication of an actual full cut diamond or other precious stones by assembling a plurality of stones cut with specific angles with a precision of 1 millionth of an inch and being assembled in a special setting so that the final jewelry piece has the look of one whole cut diamond or other precious stone. The invention provides for the homogeneity of the stones table surface and appearing essentially invisible.

U.S. Pat. No. 7,022,403 relates to an adhesive composite coating for diamond and diamond containing materials and a method for producing the coating. The coating for the diamond and diamond containing materials represents a coupling of an internal layer, made of tungsten carbide, with an external tungsten layer, both layers being fluorine alloyed.

U.S. Pat. Nos. 6,258,418 and 6,514,605 relate to a diamond-tiled workpiece for durable surfaces. The invention comprises a method for producing a durable, non-stick, diamond tilled implement and the diamond tilled implement thereby produced. Diamond particles are distributed on a surface of a workpiece containing a ceramic binder. The ceramic binder on the surface of the work piece is heated to above its glass temperature to fuse the diamond particles in and onto the workpiece. The workpiece is then cooled so that the diamond particles are bonded to and at least partially embedded in the ceramic binder at the surface of the workpiece to produce durable, non-stick, diamond tilled implements including cookware, bakeware, hot presses, ski surfaces, skid surfaces, marine articles, and mechanically polishing wheels.

U.S. Pat. No. 4,809,417 relates to a method of making a multiplet jewelry product with internally imbedded visual indicia. A multiplet jewelry product is constructed of two or more layers of material affixed together having visual indicia secured there between. Affixation is accomplished using adhesive materials.

SUMMARY OF THE INVENTION

The present invention relates to a piece of jewelry comprising a base. The base has a crevice or crevices within it to hold jewelry. Precious stones which comprise chip stones, or very small stones are placed within the crevice. Costume jewelry pieces can also be used. The jewelry piece further comprises an adhesive and a slurry comprising a ceramic and diamond dust.

The present invention relates to a method of making a piece of jewelry comprising placing a first a layer of stones facing down is placed within the crevice. A layer of liquid ceramic is placed on top of these stones. The ceramic layer and stones are then cured. Next a layer of higher quality stones are placed on top of the first layer and then cured.

It is an object of the present invention to cure the ceramic layer with a blue light.

It is an object of the present invention to cure the ceramic layer using fluorescent or incandescent light.

It is an object of the present invention when placing the bottom stones in to add an adhesive layer beneath the precious stones in the crevice of the jewelry piece.

It is an object of the present invention to add acetone to get rid of any ceramic which is on the top layer of the precious stones.

It is an object of the present invention to fix any holes between any of the precious stone pieces.

It is an object of the present invention for the precious stones to comprise diamonds.

It is an object of the present invention to remove any material which is sticking out or protruding from the jewelry piece.

It is an object of the present invention to electro clean or steam the jewelry piece.

The present invention relates to a method for creating a jewelry piece out of chipped or small precious stone pieces. A piece of jewelry having a crevice within it is lined within an adhesive layer. A layer of precious stones top layer facing down is placed on the adhesive layer. The precious stones are poured into the crevice having the adhesive layer and manipulated so that all the precious stones are facing downward. After that a further layer of precious stones is placed on top of the bottom layer facing upward. A liquid ceramic is poured between the precious stones. The jewelry piece is cured for approximately 5 to 6 minutes to set the piece. Then the jewelry is cured for approximately 40 to 45 minutes. Acetone is then used to remove any ceramic which is left on top of the stones. Any holes are then fixed with further precious stone material and any pieces sticking out of the jewelry piece are removed.

It is an object of the present invention to then clean and steam the article of jewelry.

It is an object to create the jewelry piece like tiling a floor. The stones are laid on a wet surface and placed in a pattern. They are then cured and a clear material is placed on top of the stones and then the stones are cured again.

It is an object of the present invention to prepare the jewelry piece under a microscope and under magnification.

It is an object of the present invention to prepare the jewelry piece on a flat secure surface.

It is an object of the present invention to use blue light to harden the jewelry piece.

It is an object of the present invention to polish the jewelry piece once it is finished.

It is an object of the present invention to prepare a jewelry piece having lips on the outside of the jewelry piece. An adhesive is placed on the metal in the crevice of the jewelry piece and then cured. A ceramic liquid is mixed with diamond dust to form a slurry which is then placed on the adhesive cured metal. Stones are then placed on the slurry. The stones can be pressed down, pulled out or changed.

It is an object of the present invention for the ceramic liquid to be a clear high gloss ceramic liquid.

It is an object of the present invention to use stones of different shapes, sizes, and colors.

It is an object of the present invention to make sure the stones are all level after they are placed in the slurry.

Once the stones are placed in a slurry, the jewelry piece is cured.

It is an object of the present invention to cure the stones under blue light.

It is an object of the present invention to cure the jewelry piece for approximately 5 minutes under blue light. A user can cure the jewelry piece under less intense light for a longer time. Once the diamonds are stiff, a user places fill in material so there are no air spaces left in the jewelry piece.

It is an object of the present invention to use a vacuum to press all the stones down. A user can use different sizes and shaped stones to fill in the different spaces.

It is an object of the present invention for the jewelry pieces to be rings, broaches, pins, cufflinks, earrings, bracelets, necklaces, and watches.

It is an object of the present invention to have polished diamonds in many shapes and sizes poured into a high gloss ceramic set in a mixture of silver, platinum or gold.

It is an object of the present invention to sculpt loose polished stones into jewelry.

BRIEF DESCRIPTION OF THE INVENTION

FIG. 1 shows a side view of a jewelry piece of the present invention.

FIG. 2 shows a top view of a jewelry piece of the present invention.

DETAILED DESCRIPTION OF THE INVENTION

FIG. 1 shows a jewelry piece 10 having different shaped stones 12 within a crevice 14.

FIG. 2 shows a top view of FIG. 1 showing the jewelry piece 10 having different shaped stones 12 within a crevice 14.

Figure 3:
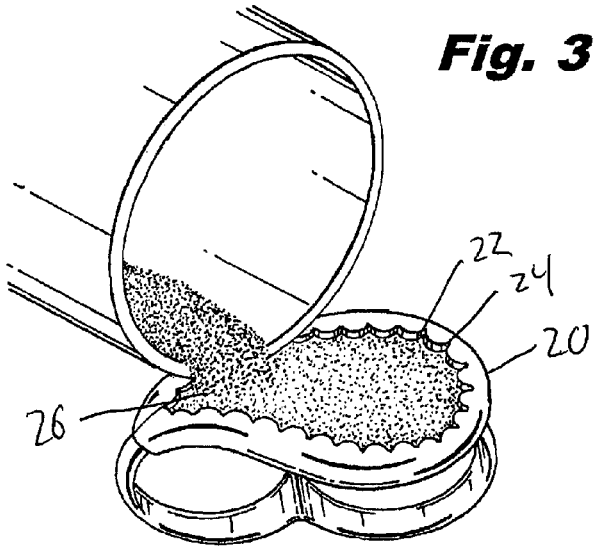
FIG. 3 shows a top view of a jewelry piece filled with a slurry.

FIG. 3 shows a jewelry piece 20 having a crevice 22 which is first filled with adhesive 24. A user then puts a slurry 26 which is composed of a ceramic liquid and diamond dust.

Figure 4:
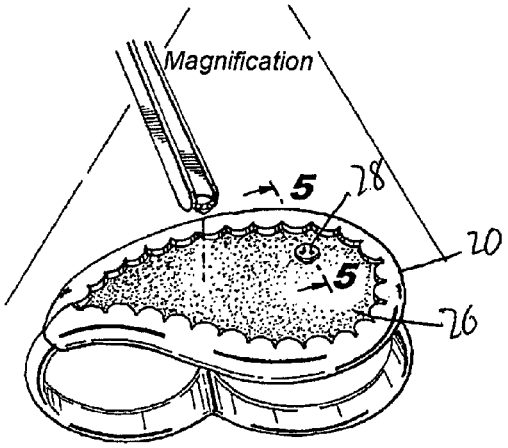
FIG. 4 shows a top view of a jewelry piece filled with a slurry and a precious stone.

FIG. 4 shows the jewelry piece 20 having the slurry 26 having a stone 28 placed in it.

Figure 5:
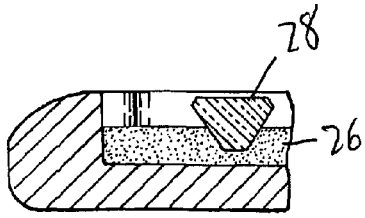
FIG. 5 shows a cross section of FIG. 4.

FIG. 5 shows a cross section of FIG. 4 wherein the stone 28 is placed within the slurry 26.

Figure 6:
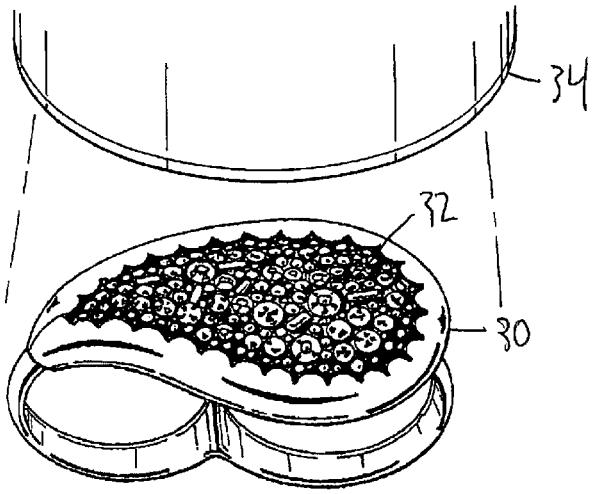
FIG. 6 shows a top view of a jewelry piece of the present invention.

FIG. 6 shows the jewelry piece 30 having the stones 32 being cured by a light source 34.

Figure 7:
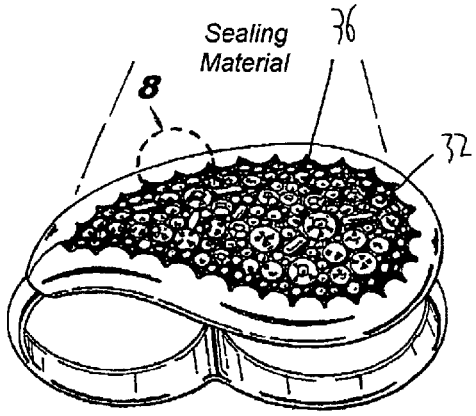
FIG. 7 shows a top view of a jewelry piece of the present invention.

FIG. 7 shows the jewelry piece having a sealing material 36 placed over the stones 32.

Figure 8:
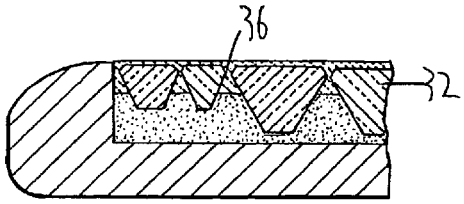
FIG. 8 shows a cross-sectional view of FIG. 7.

FIG. 8 shows a cross section of FIG. 7 wherein the stones 32 having a sealing material 36 placed over the stones.

Figure 9:
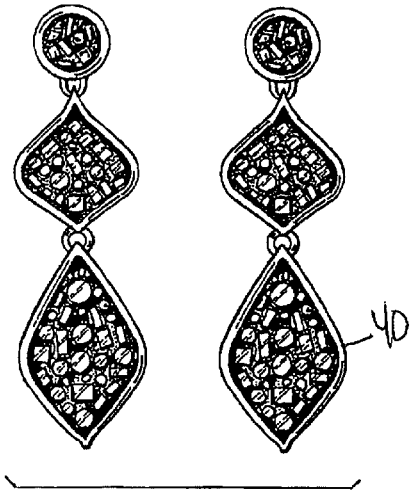
FIG. 9 shows a final piece of jewelry of the present invention.

FIG. 9 shows a jewelry piece made by the process of the present invention being in the form of earrings 40.

Figure 10:
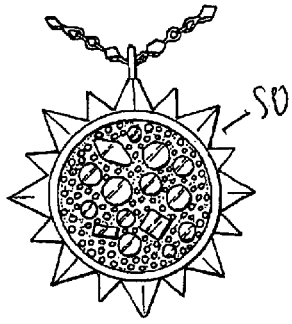
FIG. 10 shows a final piece of jewelry of the present invention.

FIG. 10 shows a jewelry piece made by the process of the present invention being in the form of a pendant 50.

Figure 11:
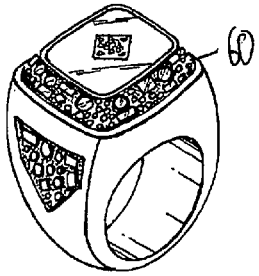
FIG. 11 shows a final piece of jewelry of the present invention.

FIG. 11 shows a jewelry piece made by the process of the present invention being in the form of a ring 60.

The invention claimed is:

1. A method of preparing a jewelry piece having lips on an outside surface comprising:

placing an adhesive on a metal surface of a crevice of said jewelry piece;

mixing a ceramic liquid with diamond dust to form a slurry;

placing said slurry on said adhesive in said crevice;

placing stones in a pattern on top of said slurry and in said crevice so that said stones are held solely by said slurry;

curing said slurry to stiffen said stones;

placing clear material on said stones and further curing said jewelry piece.

2. The method of claim 1 wherein said ceramic liquid is a clear high gloss ceramic liquid.

3. The method of claim 1 wherein said stones are of different shapes and sizes.

4. The method of claim 1 wherein said stones are all level after they are placed in said slurry.

5. The method of claim 1 wherein said slurry is cured under blue light.

6. The method of claim 5 wherein said slurry is cured for approximately 5 minutes under the blue light.

7. The method of claim 1 wherein said curing of said slurry is under less intense light than a blue light for a longer period of time than 5 minutes.

8. The method of claim 1 wherein a vacuum is used to press all said stones.

9. The method of claim 1 wherein said stones are of different colors.

10. The method of claim 1 wherein said stones are cured using fluorescent or incandescent light.

11. The method of claim 1 further comprising adding acetone to said jewelry piece to get rid of any excess material which is on top of said stones.

12. The method of claim 1 further comprising fixing any holes between any of said stones.

13. The method of claim 1 further comprising: electro cleaning or steaming said stones.

14. The method of claim 1 wherein said stones are placed in said slurry under a microscope under magnification.

* * * * *